United States Patent [19]

Connor

[11] Patent Number: 4,565,532

[45] Date of Patent: Jan. 21, 1986

[54] STERN DRIVE

[75] Inventor: John A. Connor, Costa Mesa, Calif.

[73] Assignee: Kaama Marine Engineering, Inc., Costa Mesa, Calif.

[21] Appl. No.: 235,573

[22] Filed: Feb. 18, 1981

[51] Int. Cl.[4] ..... B63H 23/02

[52] U.S. Cl. ..... 440/57; 440/61; 440/75

[58] Field of Search ..... 440/75, 53, 57–63

[56] References Cited

U.S. PATENT DOCUMENTS

| | | | |
|---|---|---|---|
| 317,582 | 5/1885 | Schulze-Berge | 440/59 |
| 3,057,320 | 8/1960 | Daniels | 440/62 |
| 3,136,287 | 6/1964 | North | 440/57 |
| 3,376,842 | 4/1968 | Wynne | 440/56 |
| 3,403,655 | 10/1968 | Warburton | 440/57 |
| 3,430,603 | 3/1969 | Parish | 440/63 |
| 3,626,467 | 12/1971 | Mazziotti | 440/61 |
| 3,628,492 | 12/1971 | Baldwin et al. | 440/75 |
| 3,933,116 | 1/1976 | Adams et al. | 440/61 X |
| 3,951,096 | 4/1976 | Dunlap | 440/75 |

FOREIGN PATENT DOCUMENTS

| | | |
|---|---|---|
| 574918 | 1/1946 | United Kingdom . |
| 1044931 | 10/1966 | United Kingdom . |
| 1524184 | 9/1978 | United Kingdom . |

*Primary Examiner*—Sherman D. Basinger
*Attorney, Agent, or Firm*—Lyon & Lyon

[57] ABSTRACT

A drive mechanism for a boat having the motor located inboard. The mechanism disclosed includes a gearbox located outboard of the transom with an input shaft extending toward the inboard motor and an output shaft extending aft toward a propeller shaft. A universal joint coupling is provided to drive the propeller shaft while a gimbal ring is employed to universally mount a propeller shaft housing such that the propeller may be used for steerage as well as forward thrust. The gearbox is disclosed as including a first gear pair capable of being changed to provide different output ratios. A second drive link in the gearbox gives a selection of directions of rotation of the propeller shaft. In a first instance, a gear pair is employed. In a second instance, a chain drive is employed. Access is provided into the gearbox by a plate located between the gearbox and the transom. This plate provides a mounting for the drive links within the gearbox. Another gearbox having a single gear pair is also disclosed for lowering the level of the propeller shaft relative to the boat hull.

1 Claim, 8 Drawing Figures

STERN DRIVE

BACKGROUND OF THE INVENTION

The field of the present invention is drive mechanisms for power boats. More specifically, the present invention is directed to mechanisms for transmitting power from an inboard motor of a power boat to a propeller.

A variety of mechanisms for providing power to a propeller for driving a boat have been employed, both successfully and unsuccessfully, since at least the 1800's. Two general categories of such devices employed with inboard motors have developed. Early on, fixed propeller shafts were developed which generally required a second mechanism, a rudder, for steering. More recently, devices known as inboard-outboards or stern drives have been developed which employ an articulated propeller shaft coupled with an inboard motor. These devices do not generally require additional steering mechanisms as the thrust from the propeller or propellers may be directed to effect steering much as a conventional outboard motor is employed.

Two mechanisms may be considered representative of the types of stern drives presently available. The first is illustrated in the North patent, U.S. Pat. No. 3,136,287. This device employs a horizontal input shaft, a vertical power transmission shaft, and a horizontal propeller shaft. This type of stern drive provides certain advantages of outboard motor flexibility and steering control. However, vertical shaft stern drives are typically rather inefficient because of the required gearing. The second type is represented by the Adams et al. patent, U.S. Pat. No. 3,933,116. This patent employs an inclined shaft from the inboard motor to an outboard, articulated propeller shaft. For reasons pointed out below, the engine disadvantageously must be placed low in the bilge, must be inclined and must be forward in the boat, particularly if gearing is required.

Coincident with the development of power trains for boats, improved propeller performance has also been achieved. To date, it is understood to be beneficial to run the propeller of high speed, competition type boats only about 55% submerged in the water. It is also believed to be beneficial to have the axis of the propeller angled downwardly relative to the keel line by a maximum of about two to three degrees. Finally, a factor affecting the overall performance of the propeller and the hull is to have a relatively low center of thrust. Because of these desirable factors for high speed performance, the inboard motor of the Adams et al. device must be located low, at an angle, and as far forward as possible. The North type stern drive is better able to accomplish a desired propeller orientation. However, as mentioned above, substantial efficiency is lost in the power train.

SUMMARY OF THE INVENTION

The present invention is directed to a power train for a boat having an inboard motor and a stern drive propeller. The invention includes a gear box located exterior to the hull for achieving the proper propeller attitude relative to the hull without the inefficiency of circuitous drive train lengths. This result accomplished by the present invention is achieved through the employment of an outboard gear box having parallel shafts each positioned in a generally horizontal orientation and being positioned relative to one another in a generally vertical arrangement, the lowermost of the shafts being the output shaft.

The arrangements contemplated by the present invention do not achieve the appropriate orientation of the propeller shaft at the expense of inboard motor placement. Instead, the present system also improves the placement of the inboard motor by allowing it to be positioned as far aft as the inboard side of the transom. It is also contemplated that the inboard position of the motor will be substantially horizontal relative to the hull and may be located up out of the bilge. In spite of this more advantageous placement of the inboard motor, the center of thrust is located low in the stern and is not tending to force the stern up and bow down.

The devices contemplated by the present invention also may enjoy other advantages. The outboard location of the gear box removes the gear box from the relatively stagnant, heated environment of the engine compartment and places it in a position to receive both water and air cooling. The gear box housing may be arranged to avoid exposed joints by employing a unitary structure with an access plate located between the gear box and the transom. When a configuration is selected employing a high location of the input to the gear box, an improved inboard motor position and a protected access plate, the sealing problems are reduced to the area of the output shaft, a problem long overcome in more conventional arrangements.

In the embodiment employing the gearbox having an input shaft, an output shaft and an intermediate idler shaft, two selectable features may be employed. Between the idler shaft and one of the input and output shafts a gear pair selected from a plurality of available gear pairs may be employed to select the appropriate stepdown in speed to achieve the maximum efficiency of both the engine and the propeller under any given conditions. The other link with the idler shaft may be employed as a device for selecting direction of rotation of the propeller. To this end, either a gear pair or a chain and sprocket arrangement may be selected. The gear pair naturally causes counter-rotation of the shafts supporting the gear pair while the chain and sprocket arrangement results in shaft rotations in the same direction.

In the context of competitive boating, time considerations can become significant. To enhance the ease of gear ratio and direction changes, an embodiment of the present invention may employ the access plate referred to above as a bearing support for one end of each of the input, idler and output shafts. By simply removing the access panel, the gear wheels and sprocket wheels are immediately accessible for quick removal and replacement.

Accordingly, it is an object of the present invention to provide an improved drive train for a stern drive. Other and further objects and advantages will appear hereinafter.

DETAILED DESCRIPTION OF THE PREFERRED EMBODIMENT

Figure 1:
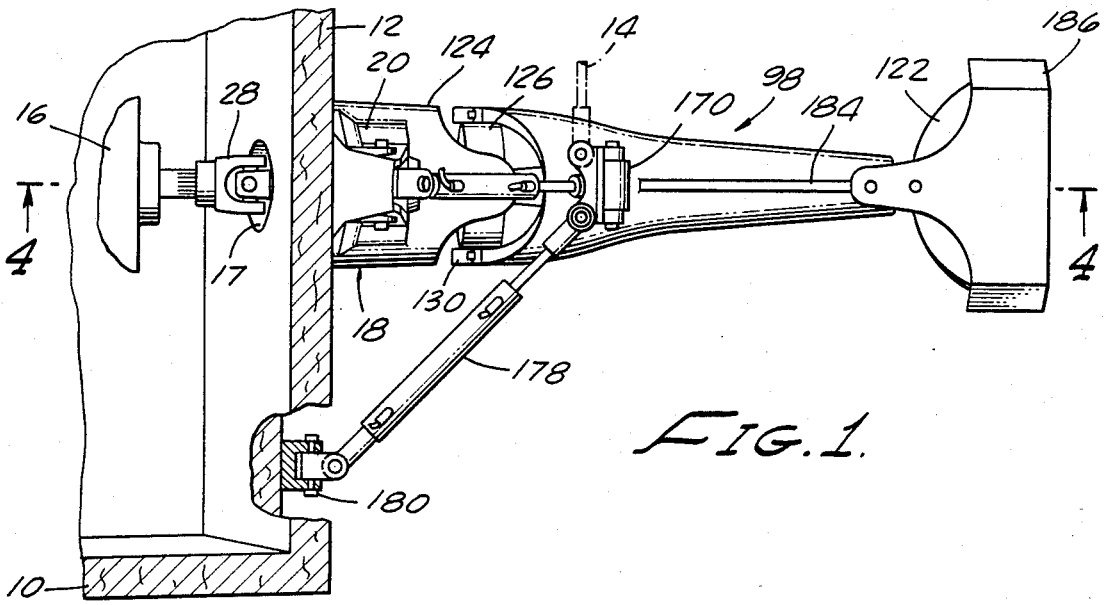
FIG. 1 is a plan view of a first embodiment of the present invention shown positioned on a boat. The hull has been partially sectioned for clarity of illustration.
Figure 2:
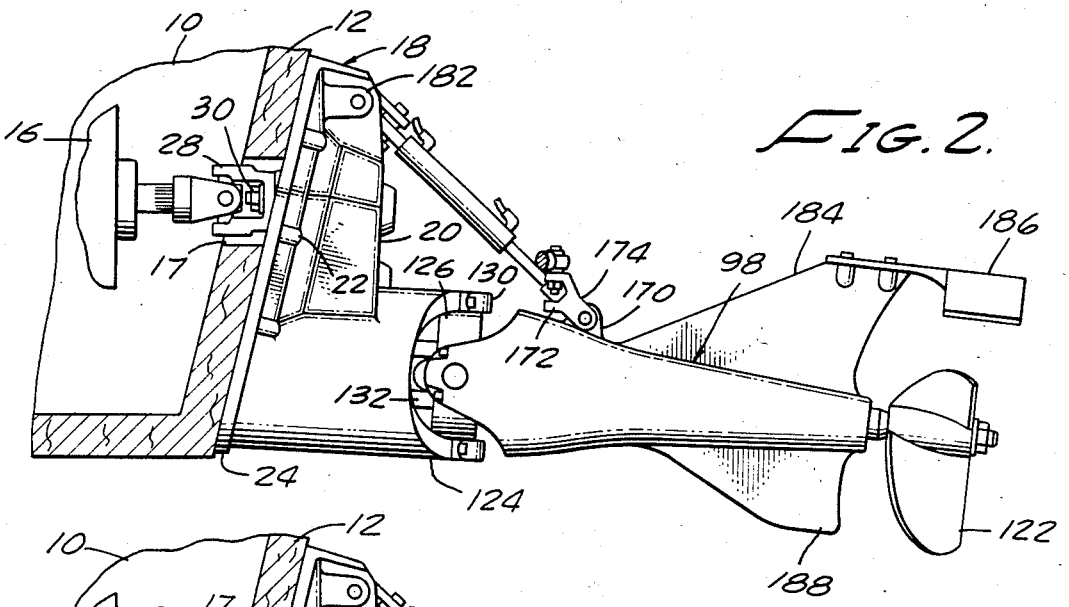
FIG. 2 is a side view of the embodiment of FIG. 1 with the boat hull sectioned along line 4—4.

Turning in detail to the drawings, FIGS. 1 and 2 illustrate the arrangement of a first embodiment of the present invention in association with a hull 10. The hull 10 includes a transom 12. The hull illustrated in FIG. 1 may represent either of two configurations. The first configuration would be that of a small boat wherein the drive is positioned centrally in the hull. In a second configuration, the portion of the hull illustrated may simply be the port side thereof. In such an event, a link, shown in phantom as 14, may be employed to control a second stern drive located on the starboard side of the hull.

Located inboard within the hull 10 is an inboard motor 16. Consistent with this preferred embodiment of the present invention, the inboard motor 16 is illustrated as being horizontally disposed relative to the hull 10 and positioned well out of the bilge. A hole 17 provides access between the motor and the stern drive.

In the embodiment of FIGS. 1 and 2, a gearbox, generally designated 18, is securely positioned to the outboard side of the transom 12. The gearbox 18 includes a gear box housing 20 which is generally configured in a functional manner to enclose the drive train and to provide structural support for the articulated propeller shaft housing. The gearbox 18 is held to the transom 12 by conventional means such as bolts. The bolts are distributed about the gear box housing 20 for optimum support and sealing with the transom 12. Where necessary, such as at location 22, clearance is made for facile placement of the bolts. The housing 20 generally includes a flange 24 which receives the fastening means.

Figure 4:
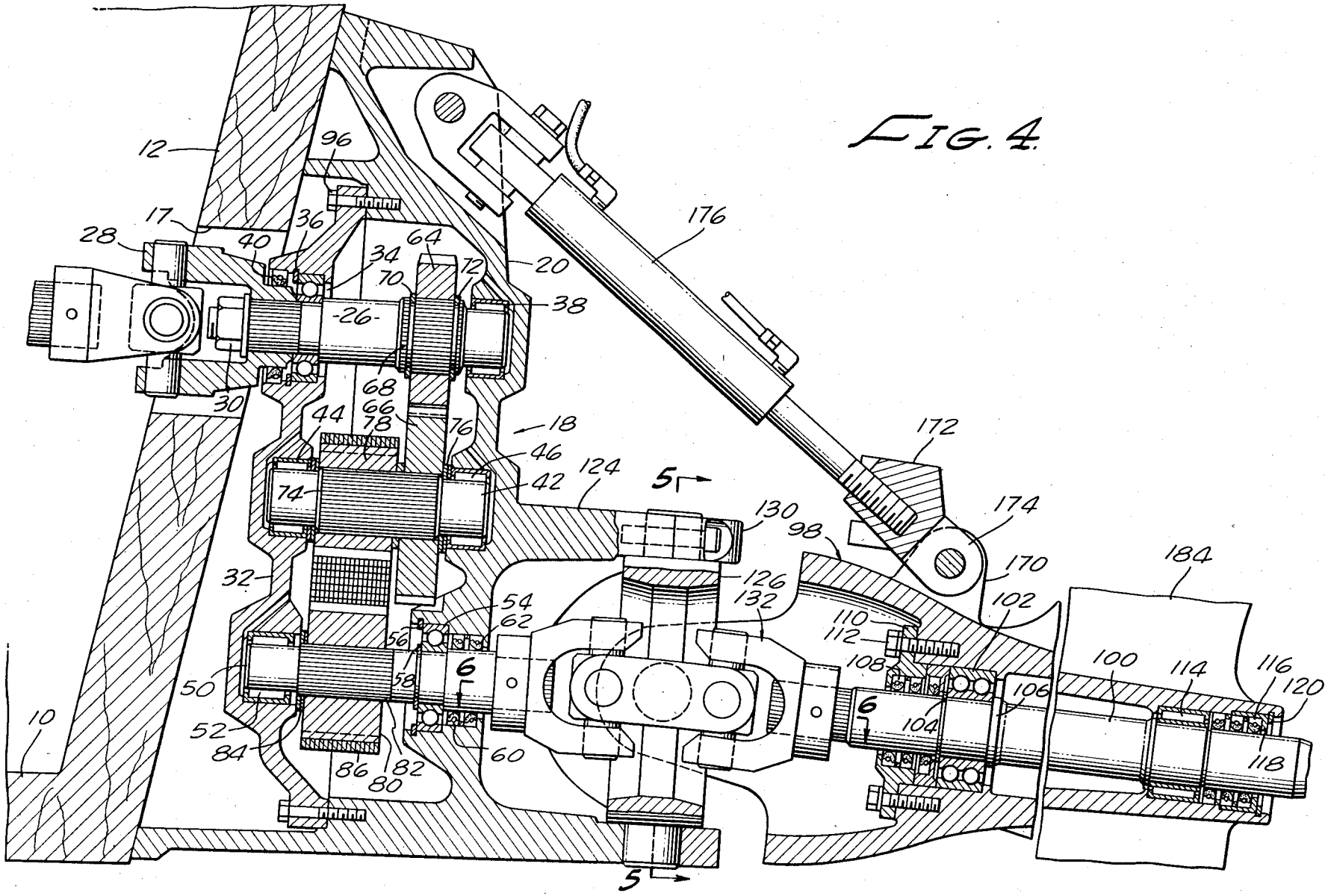
FIG. 4 is a cross-sectional elevation taken along line 4—4 of FIG. 1.
Figure 5:
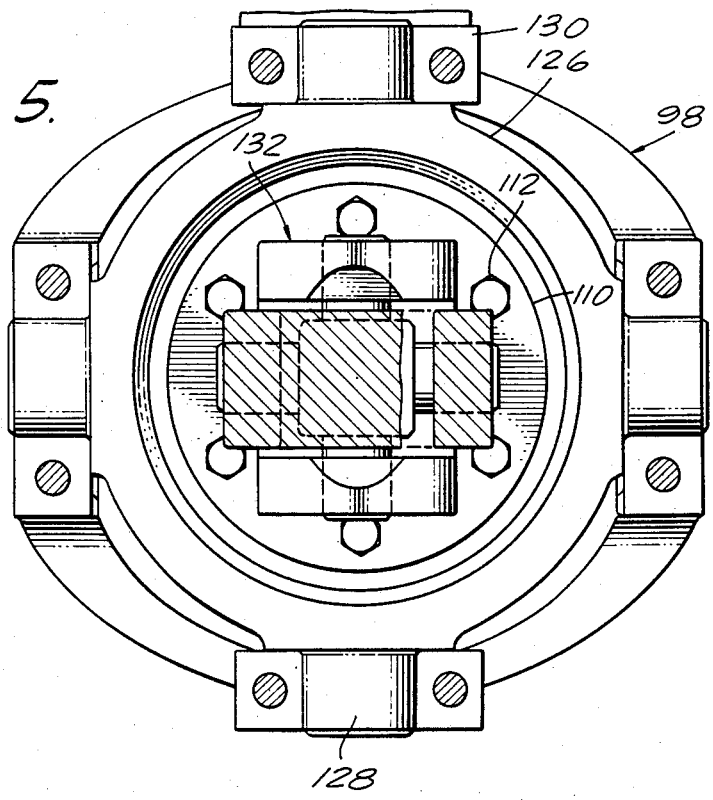
FIG. 5 is a cross-sectional inview taken along line 5—5 of FIG. 4.
Figure 6:
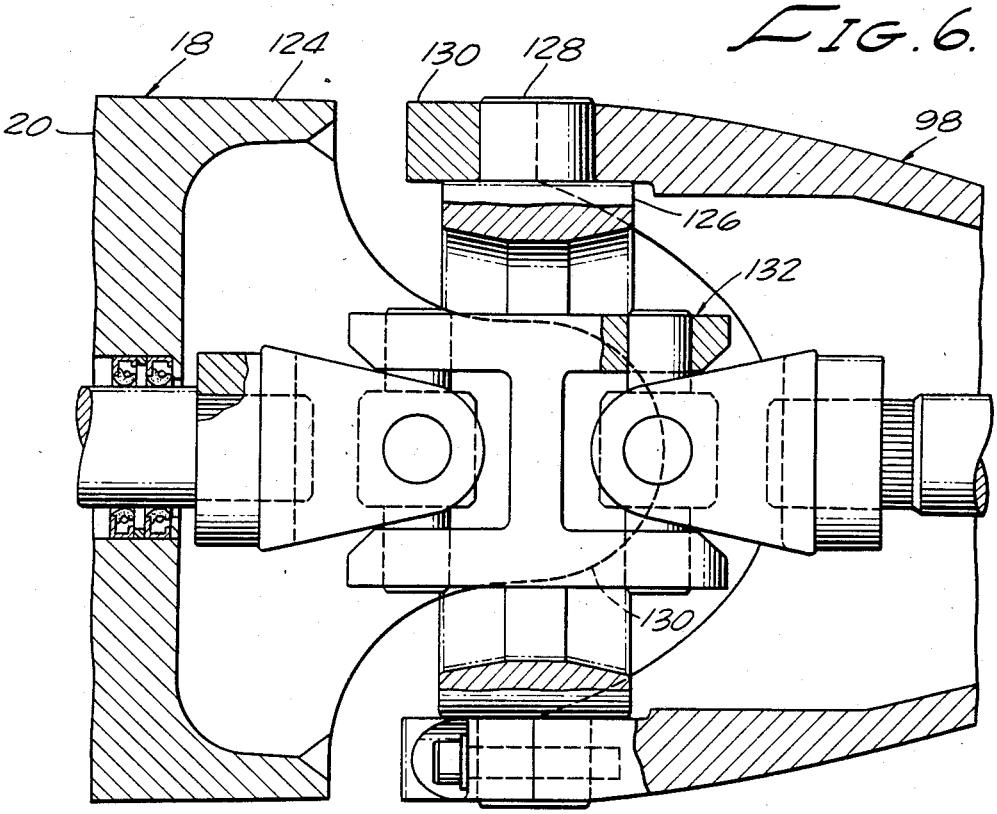
FIG. 6 is a cross-sectional plan view taken along line 6—6 of FIG. 4.

Turning to the arrangement of the drive train within the gearbox housing 20 as illustrated in FIG. 4, an input shaft 26 extends forward from the gearbox 18 for access through hole 17 to the inboard area of the hull where it is coupled to receive power from the inboard motor 16. The actual coupling between the motor 16 and the input shaft 26 is via a universal joint 28. Any conventional form of attachment may be employed to affix the U-joint 28 to both the output shaft of the inboard motor 16 and the input shaft 26 of the gearbox 18. In the present embodiment, splines are illustrated. The U-joint 28 is held on the splines of the input shaft 26 by means of a stud and bolt assembly 30. The employment of the U joint 28 gives certain convenience advantages. The U joint allows the inboard motor location and orientation to be less critical. With the use of the U joint 28, bearing failure from shaft misalignment of the motor 16 is avoided. In fact, the inboard motor 16 may be intentionally placed at some angle relative to the input shaft 26 where convenient. Furthermore, fore and aft placement of the inboard motor 16 is less critical if the splines of the drive shaft from the inboard motor 16 are allowed to telescope in and out of the U joint 28. Not only is initial placement of the inboard motor 16 greatly simplified by the U-joint 28, the structural rigidity of the hull is not so critical. Naturally, boat hulls are designed to exhibit a certain amount of elastic strain. To attempt to design a hull to prevent such substantial elastic strain would greatly increase the weight of the boat even if such a goal was possible. Consequently, this stern drive must experience substantial relative movement between the gear box 18 and the inboard motor 16. The U-joint 28 accommodates this elastic strain.

The input shaft 26 extends through an access plate 32 which, in this embodiment, is positioned between the gearbox 18 and the transom 12. In this way, the joint between the access plate 32 and the gearbox housing 20 is protected from the harsh water environment in which the present invention is designed to be used. The access plate 32 provides for convenient ratio and direction of rotation selection as will be more fully discussed below.

The input shaft 26 is supported by a ball bearing 34 held within the access plate 32 by means of a split ring retainer 36. The other end of the input shaft 26 is supported in a bearing cavity provided in the gear box housing 20 by a roller bearing 38. The roller bearing 38 may be conveniently press fit into the cavity provided therefor. A seal 40 forms an appropriate closure around the input shaft 26.

Located centrally in the gear box 18 is an idler shaft 42. The idler shaft 42 is supported at each end by roller bearings 44 and 46. The roller bearings 44 and 46 are positioned in the access plate 32 and the gear box housing 20 respectively.

Located in the lower portion of the gearbox 18 is an output shaft 50. The output shaft 50 is supported at a first end in the access plate 32 by means of a roller bearing 52. At the output end of the output shaft, a ball bearing 54 is employed. The ball bearing 54 is held in place by a split ring retainer 56 while the output shaft 50 is held relative to the ball bearing 54 which, as is true of ball bearing 34, is capable of resisting axial loading. Outwardly of the ball bearing 54 are seals 60 and 62. The output shaft 50 extends aft relative to the hull to provide aft access for coupling with the propeller shaft to provide power from the inboard motor 16 as driven through the gearbox.

Figure 7:
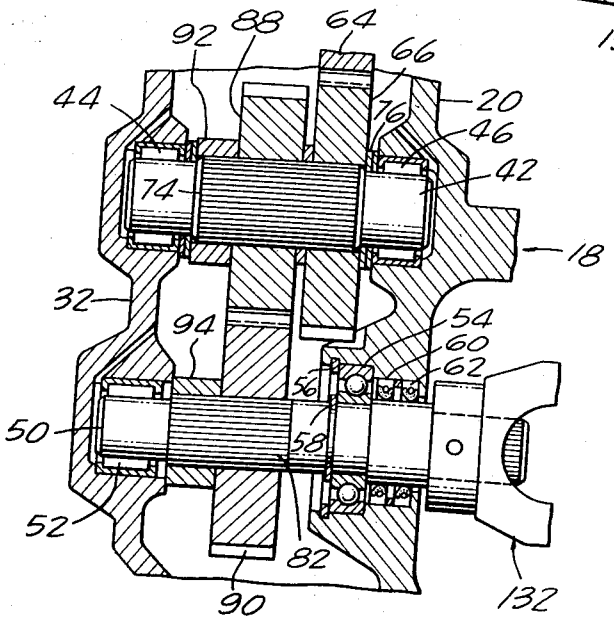
FIG. 7 is a detailed cross-sectional elevation illustrating a gear pair in place of the chain and sprocket assembly illustrated in FIG. 4.

To provide power through the gear box 18, the input shaft 26 and the idler shaft 42 include a first gear pair including gear wheels 64 and 66. The gear wheels 64 and 66 may be replaced by other gear pairs to provide gear ratio selection. The gear wheel 64 of the ratio selectable gear pair is constrained to rotate with the input shaft 26 by means of splines 68. Split ring retainers 70 and 72 retain the gear wheel 64 in position on the splines 68. The gear wheel 66 is similarly associated with splines 74 on the idler shaft 42. A plurality of spacing washers 76 provide axial spacing for the gear wheel 66 as well as the idler shaft 42. Coupling the idler shaft 42 with the output shaft 50 is a direction selectable drive assembly which may be provided either by a chain coupling as illustrated in FIG. 4 or a second gear pair as illustrated in FIG. 7. The choice between the chain coupling of FIG. 4 and the gear pair of FIG. 7 determines the direction of rotation of the output shaft 50 but otherwise provides little difference in operation.

To accommodate the chain coupling of FIG. 4, the idler shaft 42 includes an extended splined shoulder to couple with a first sprocket wheel 78. A second sprocket wheel 80 is located on a splined portion 82 of the output shaft 50. The first sprocket wheel 78 is positioned axially by means of the spacing washers 76 while the second sprocket wheel 80 is held axially from the access plate 32 by means of spacers 84. Coupling the sprocket wheels 78 and 80 is a chain 86. The chain coupling provided by the sprocket wheel 78 and 80 and the chain 86 causes the idler shaft 42 and the output shaft 50 to rotate in the same direction.

The second gear pair illustrated in FIG. 7 may be employed to replace the chain coupling of FIG. 4 when rotation of the output shaft in the opposite direction is desired. The gear pair of FIG. 7 includes gear wheels 88 and 90 fixed to the splines 74 and 76 of the idler shaft 42 and output shaft 50 respectively. Additional spacing to properly locate this second gear pair of the direction selectable drive assembly is provided by washers 92 and 94. Through this gear pair, the idler shaft 42 and the output shaft 50 rotate in different directions.

As indicated above, the access plate 32 provides a convenient means for changing either the gear ratio of the gearbox 18 or the output direction. With the entire stern drive assembly removed, the access plate 32 may be disassembled from the gearbox housing 20 by removal of fasteners 96. This removal of the access plate 32 exposes the ends of the idler shaft 42 and the output shaft 50 and removes the input shaft 26. Quick replacement of the couplings between any of the shafts may then be effected.

The location of the three shafts, the input shaft 26, the idler shaft 42, and the output shaft 50, are conveniently arranged in the preferred embodiment along parallel, substantially horizontal axes. The parallel nature of these shafts avoids the necessary inefficiency associated with beveled gears and the like. The substantially horizontal arrangement requires only small angles of bending of the U-joints associated with this stern drive between the inboard motor 16 and the gearbox 18 and between the gearbox 18 and the propeller. Small angles through which the U-joints must operate adds to their efficiency and longevity of operation. The three shafts are also positioned in a vertical arrangement with the input shaft 26 above the idler shaft 42 which is in turn above the output shaft 50. This vertical arrangement provides for a placement of the inboard motor 16 above the bilge of the boat and for the delivery of output power about a horizontal shaft very near the keel line of the hull. In fact, in the preferred embodiment the output shaft 50 is placed just far enough above the inner section of the keel and the transom so that the housing 20 of the gear box 18 does not extend below the end of the transom to create additional drag.

Located aft of the gearbox 18 is a propeller shaft housing generally designated 98. The housing of the embodiment illustrated in FIGS. 1, 2 and 4 includes a propeller shaft 100 rotatably mounted therein. The propeller shaft 100 is mounted at its forward end in a thrust bearing 102. The propeller shaft 100 is fixed relative to the thrust bearing 102 by means of a split ring retainer 104 and a shoulder 106 on the shaft. The bearing 102 and the interior of the propeller shaft housing 98 is protected by a plurality of seals 108 held in place by a retainer cap 110 and fasteners 112. At the aft or distal end of the propeller shaft 100, it is rotatably mounted in the propeller shaft housing 98 by a roller bearing 114. A plurality of seals 116 protect the distal end of the propeller shaft housing 98 from water intrusion. A cap 118 and a split ring retainer 120 retain the seals and bearing in position. A propeller 122 is conventionally mounted to the end of the propeller shaft 100. The propeller shaft housing 98 is fixed to a mount 124 which, in this embodiment, is formed as an integral part of the gear box housing 20. If no gear box is employed, the mount 124 may be directly affixed to the transom 12. Coupled to the mount 124 is a mounting means for retaining the propeller shaft housing 98 yet allowing the housing 98 universal pivotal motion such that the propeller shaft housing 98 may be pulled up out of the water or extended down further into the water or may be pivoted laterally for steering. Appropriate portions of the mount 124 and the propeller shaft housing 98 are cut away to provide the necessary clearance for such movement. The mounting means includes in this preferred embodiment of a gimbal ring 126. Gimbal lugs are formed on each of the mount 124 and the propeller shaft housing 98 to receive the gimbal pins 128 of the gimbal ring 126. The gimbal lugs are split and include lug caps 130 on both the mount 124 and the propeller shaft housing 98.

The propeller shaft housing 98 is gimbaled to the mount 124 concentrically about a coupling means for transmitting power from the output shaft 50 to the propeller shaft 100. This coupling means accommodates a range of colinear and non-collinear orientations of the two shafts and, in the present embodiment, is provided by a universal joint generally designated 132. The universal joint 132 is directly coupled to both the output 50 and the propeller shaft 100 in a conventional manner.

To protect the gimbal 126 and the universal joint 132, it is contemplated that a boot (not shown) be positioned in sealed engagement with the mount 124 and extending into a similar sealed engagement with the propeller shaft housing 98. In this way, moisture can be excluded from the area of both the mounting and coupling means for the gimbaled propeller shaft. The boot, of course, requires substantial flexibility to accommodate the gimbaled motion of the propeller shaft housing 98.

Figure 3:
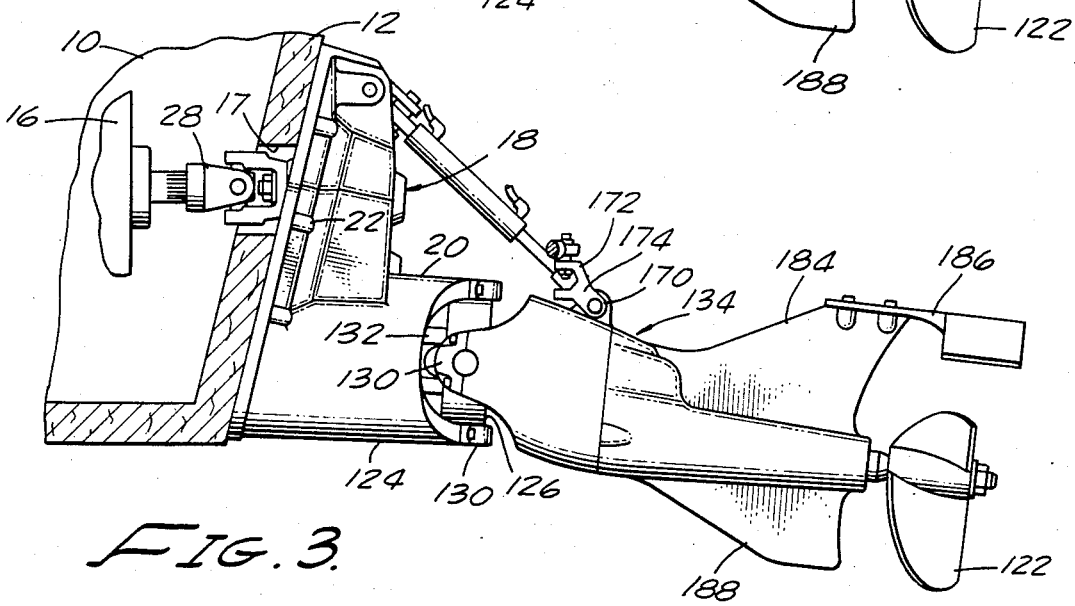
FIG. 3 is a second embodiment of the present invention illustrated in a side view similar to that of FIG. 2.
Figure 8:
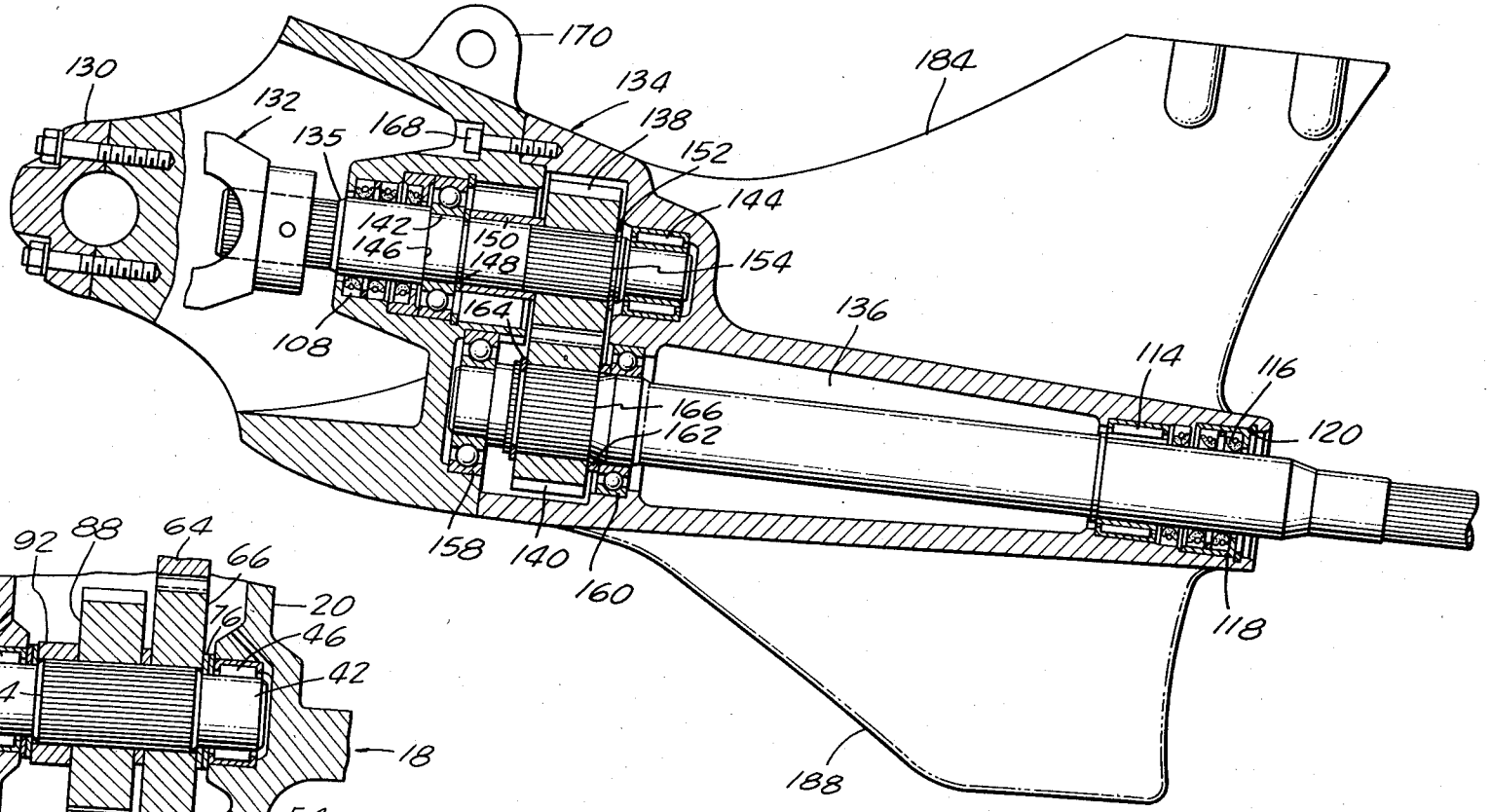
FIG. 8 is a cross-sectional elevation of the embodiment illustrated in FIG. 3.

In an alternate embodiment illustrated in FIGS. 3 and 8, a gear box is also located within a modified propeller shaft housing 134. The modified propeller shaft housing includes an input shaft 135 and an output shaft 136. Together the input shaft 135 and the output shaft 136 combine to form a propeller shaft assembly. A gear pair consisting of gear wheels 138 and 140 couple the propeller shafts 135 and 136 together. The input propeller shaft 135 is mounted at a first end by a ball bearing 142 and at a second end by a roller bearing 144. The ball bearing 142 is retained by a shoulder 146 and a split ring retainer 148. A spacer 150 and another split ring retainer 152 retain the gear wheel 138 in position. The gear wheel 138 is caused to rotate with the shaft 135 by means of a coupling with splines 154.

The output propeller shaft 136 is rotatably mounted in the propeller shaft housing 134 by means of two ball bearings 158 and 160. The gear wheel 140 is held in place on the shaft 136 by means of a spacer 162 and a split ring retainer 164. Splines 166 insure coupled rotation of the gear wheel 140 with the shaft 136. At the distal end of the output propeller shaft 136, the same sealing arrangement is employed as was described with regard to the device of FIG. 4.

The gear pair provided by gear wheels 138 and 140 are employed in the modified propeller shaft housing 134 to lower the center of thrust of the stern drive without inducing further angular offset with the keel line. At the location where the gear pair is arranged, less drag is encountered than if the gear box 18 were to be positioned such that it extended below the bottom of the transom 12. Thus, improved propeller performance is achieved with out substantially increasing the drag of the stern drive in the water.

Naturally, the propeller shaft housing 134 is configured as narrow as possible about the gear pair located therein. The propeller shaft housing 134 is split in a plane substantially normal to the axis of the propeller drive. Fasteners 168 are employed to retain the two portions of the propeller shaft housing 134 together and sealed.

Applicable to both of the preferred embodiments illustrated are the steering and attitude control mechanisms. In each case, a boss 170 is provided on the upper side of the propeller shaft housings 98 and 134. A control bracket 172 is pivotally mounted on the boss 170 by means of a clevis and clevis pin assembly 174. To this control bracket 172 are coupled an attitude control hydraulic cylinder 176 and a steering control hydraulic cylinder 178. Also link 14 may be coupled with the control bracket 172 when a dual stern drive arrangement is employed. The steering cylinder 178 is then fixed by means of a conventional mount 180 to the transom 12. The attitude cylinder 176 is coupled to a plurality of mounting brackets 182 located on the upper portion of the gearbox housing 20. Thus, the gimbaled propeller may be controlled in all directions by conventional hydraulics.

Also on each of the embodiments of propeller shaft housings 98 and 134 are fins available for further control. A dorsal fin 184 extends upwardly to a horizontal propeller guard 186. A skeg 188 extends downwardly from the main portion of the propeller shaft housing.

Thus, an improved stern drive arrangement is here disclosed.

While embodiments and applications of this application have been shown and described, it would be apparent to those skilled in the art that many more modifications are possible without departing from the inventive concepts herein. The invention, therefore, is not to be restricted except by the spirit of the appended claims.

What is claimed is:

1. A power train for a boat having a hull, a transom and an inboard motor, comprising an outboard gearbox rigidly fixed to the outside of the transom;

a gearbox input shaft coupled to receive power from the inboard motor;

a gearbox output shaft being parallel to and vertically below said input shaft;

a drive train in said gearbox coupling said input shaft and said output shaft and including coupling elements all rotatably mounted about axes substantially parallel to said input shaft; and a propeller shaft coupled to said output shaft and being pivotally mounted to effect steering.

* * * * *